US010975857B2

(12) United States Patent
Smith et al.

(10) Patent No.: US 10,975,857 B2
(45) Date of Patent: Apr. 13, 2021

(54) COOLING SYSYTEM MECHANICAL PUMP DIAGNOSIS

(71) Applicant: GM Global Technology Operations LLC, Detroit, MI (US)

(72) Inventors: Michael A. Smith, Clarkston, MI (US); Eugene V. Gonze, Pinckney, MI (US); Eric E. Klauser, Orchard Lake, MI (US); Christopher H. Knieper, Chesaning, MI (US)

(73) Assignee: GM GLOBAL TECHNOLOY OPERATIONS LLC, Detroit, MI (US)

( * ) Notice: Subject to any disclaimer, the term of this patent is extended or adjusted under 35 U.S.C. 154(b) by 24 days.

(21) Appl. No.: 16/570,579

(22) Filed: Sep. 13, 2019

(65) Prior Publication Data

US 2021/0079912 A1 Mar. 18, 2021

(51) Int. Cl.

| | |
|---|---|
| ***F04B 49/00*** | (2006.01) |
| ***F01P 7/14*** | (2006.01) |
| ***F04B 23/04*** | (2006.01) |

(52) U.S. Cl.

CPC ..... *F04B 49/007* (2013.01); *F01P 7/14* (2013.01); *F04B 23/04* (2013.01); *F01P 2007/146* (2013.01); *F01P 2023/08* (2013.01); *F01P 2025/32* (2013.01); *F01P 2031/00* (2013.01)

(58) Field of Classification Search

CPC ... F04B 49/007; F04B 23/04; F01P 2007/146; F01P 7/14

See application file for complete search history.

(56) References Cited

U.S. PATENT DOCUMENTS 8,915,127 B2 * 12/2014 Graf ..... F01P 7/162 73/114.68
2006/0000428 A1 * 1/2006 Yamashita ..... F01P 7/165 123/41.14

* cited by examiner

*Primary Examiner* — Kevin A Lathers

(57) ABSTRACT

A method of diagnosing a mechanical coolant pump in an automobile equipped with cooling system having a mechanical coolant pump and an electric coolant pump comprises detecting when an engine of the automobile has been started, dis-engaging the electric coolant pump, engaging the mechanical coolant pump, and verifying the mechanical coolant pump is operating properly.

13 Claims, 2 Drawing Sheets

COOLING SYSYTEM MECHANICAL PUMP DIAGNOSIS

INTRODUCTION

The present disclosure relates to a cooling system for an automobile having a mechanical cooling pump and an electrical cooling pump. Mechanical pumps are typically driven by a flywheel and a belt or chain from the engine of the automobile. This draw on the engine has a negative impact on fuel economy. Electric fuel pumps are not driven directly by the engine, and therefore, do not exhibit similar negative impact on fuel economy. However, electrical fuel pumps are designed to minimize power consumption and minimize the space they take up in the vehicle. Small, low power electric coolant pumps cannot provide sufficient coolant flow when an automobile requires above normal levels of cooling, such as when the automobile is towing a trailer or operating in high temperatures.

To accommodate all scenarios, automobile cooling systems have been developed that utilize both a mechanical coolant pump and an electric coolant pump. The mechanical coolant pump operates when high coolant flow is needed, and the electric coolant pump operates when the automobile is operating within normal limits and higher coolant flow is not necessary. The coolant system switches between the mechanical and electric coolant pumps as needed. If, however, the mechanical coolant pump fails, it is necessary to limit operation of the automobile within the limits of the electric coolant pump.

Thus, while current dual pump coolant systems achieve their intended purpose, there is a need for a new and improved system and method for operating the system that monitors operation of the mechanical coolant pump to insure that operation of the automobile is limited when the mechanical coolant pump is not functioning properly.

SUMMARY

According to several aspects of the present disclosure, a method of diagnosing a mechanical coolant pump in an automobile equipped with cooling system having a mechanical coolant pump and an electric coolant pump comprises, detecting when an engine of the automobile has been started, dis-engaging the electric coolant pump, engaging the mechanical coolant pump, and verifying the mechanical coolant pump is operating properly.

According to another aspect, detecting when an engine of the automobile has been started includes detecting when an engine of the automobile has been selectively started by an operator of the automobile and ignoring instances where the engine has been automatically started after a start/stop event or one due to hybrid electric vehicle integration.

According to another aspect, the mechanical coolant pump and the electric coolant pump each feed into a diverter valve that allows flow from only one of the mechanical coolant pump and the electric coolant pump to pass therethrough, the method further including switching the diverter valve to allow flow from the mechanical coolant pump prior to engaging the mechanical coolant pump.

According to another aspect, verifying the mechanical pump is operating properly includes verifying that the diverter valve is switched to allow flow from the mechanical coolant pump, and verifying flow of coolant through the diverter valve after the mechanical coolant pump has been engaged.

According to another aspect, verifying that the diverter valve is switched to allow flow from the mechanical coolant pump further includes receiving feedback from a sensor to identify the position of the diverter valve.

According to another aspect, the diverter valve is biased to allow flow from the electric coolant pump and switching the diverter valve to allow flow from the mechanical coolant pump prior to engaging the mechanical coolant pump includes actuating an actuator to overcome the bias within the diverter valve to switch the diverter valve to allow flow from the mechanical coolant pump, further wherein the sensor is a magnetic contact sensor that magnetically engages the diverter valve when the diverter valve is biased to allow flow from the electric coolant pump, further wherein receiving feedback from a contact sensor to identify the position of the diverter valve includes receiving feedback from the magnetic sensor identifying if the magnetic sensor is magnetically engaged with the diverter valve.

According to another aspect, the switching valve is a rotary valve and verifying that the diverter valve is switched to allow flow from the mechanical coolant pump further includes receiving feedback from a sensor to identify the rotational position of the rotary valve.

According to another aspect, the method further includes blocking coolant flow through the engine and diverting coolant flow around the engine prior to verifying flow of coolant through the diverter valve, and measuring the temperature of the engine and allowing coolant to flow through the engine after the engine has reached a pre-determined operating temperature.

According to another aspect, verifying flow of coolant through the diverter valve further includes measuring the temperature of the coolant that has been diverted around the engine immediately downstream of the diverter valve, measuring the temperature of the coolant upstream of a radiator within the automobile, and comparing the temperature of the coolant that has been diverted around the engine immediately downstream of the diverter valve to the temperature of the coolant upstream of the radiator.

According to another aspect, blocking coolant flow through the engine and diverting coolant flow around the engine further includes diverting coolant flow around the engine through an exhaust gas heat recovery unit.

According to another aspect, verifying flow of coolant through the diverter valve further includes measuring the temperature of the coolant immediately downstream of the exhaust gas heat recovery unit, measuring the temperature of the coolant upstream of a radiator within the automobile, and comparing the temperature of the coolant immediately downstream of the exhaust gas heat recovery unit to the temperature of the coolant upstream of the radiator.

According to another aspect, the method further includes dis-engaging the mechanical coolant pump, switching the diverter valve to allow flow from the electric coolant pump, and engaging the electric coolant pump, when flow of coolant through the diverter valve is verified and the temperature of the coolant that has been diverted around the engine immediately downstream of the diverter valve is approximately equal to the temperature of the coolant upstream of the radiator, and dis-engaging the electric coolant pump, switching the diverter valve to allow flow from the mechanical coolant pump, and engaging the mechanical coolant pump, when coolant flow exceeding the capabilities of the electrical cooling pump is required.

According to another aspect, the method further includes dis-engaging the mechanical coolant pump, switching the diverter valve to allow flow from the electric coolant pump, engaging the electric coolant pump, and limiting operation of the automobile, when one of flow of coolant through the diverter valve is not verified and when the temperature of the coolant that has been diverted around the engine immediately downstream of the diverter valve is not approximately equal to the temperature of the coolant upstream of the radiator.

According to another aspect, the method further includes dis-engaging the mechanical coolant pump, switching the diverter valve to allow flow from the electric coolant pump, and engaging the electric coolant pump, when flow of coolant through the diverter valve is verified and when the temperature of the coolant immediately downstream of the exhaust gas heat recovery unit is approximately equal to the temperature of the coolant immediately upstream of the radiator, and dis-engaging the electric coolant pump, switching the diverter valve to allow flow from the mechanical coolant pump, and engaging the mechanical coolant pump, when coolant flow exceeding the capabilities of the electrical cooling pump is required.

According to another aspect, the method further includes dis-engaging the mechanical coolant pump, switching the diverter valve to allow flow from the electric coolant pump, engaging the electric coolant pump, and limiting operation of the automobile, when one of flow of coolant through the diverter valve is not verified and when the temperature of the coolant immediately downstream of the exhaust gas heat recovery is not approximately equal to the temperature of the coolant upstream of the radiator.

According to several aspects of the present disclosure, a method of diagnosing a mechanical coolant pump in an automobile equipped with cooling system having a mechanical coolant pump and an electric coolant pump that each feed into a diverter valve adapted to allow flow from only one of the mechanical coolant pump and the electric coolant pump to pass therethrough and biased to allow flow from the electric coolant pump comprises detecting when an engine of the automobile has been selectively started by an operator of the automobile, blocking coolant flow through the engine and diverting coolant flow through an exhaust gas heat recovery unit, dis-engaging the electric coolant pump, actuating a solenoid to overcome the bias within the diverter valve and switching the diverter valve to allow flow from the mechanical coolant pump, engaging the mechanical coolant pump, verifying that the diverter valve is switched to allow flow from the mechanical coolant pump by receiving feedback from a contact sensor to identify the rotational position of the diverter valve, verifying flow of coolant through the diverter valve by measuring the temperature of the coolant immediately downstream of the exhaust gas heat recovery unit, measuring the temperature of the coolant upstream of a radiator within the automobile, and comparing the temperature of the coolant immediately downstream of the exhaust gas heat recovery unit to the temperature of the coolant immediately upstream of the radiator, dis-engaging the mechanical coolant pump, switching the diverter valve to allow flow from the electric coolant pump, and engaging the electric coolant pump, when flow of coolant through the diverter valve is verified and when the temperature of the coolant immediately downstream of the exhaust gas heat recovery unit is approximately equal to the temperature of the coolant immediately upstream of the radiator, dis-engaging the electric coolant pump, switching the diverter valve to allow flow from the mechanical coolant pump, and engaging the mechanical coolant pump, when coolant flow exceeding the capabilities of the electric cooling pump is required, and dis-engaging the mechanical coolant pump, switching the diverter valve to allow flow from the electric coolant pump, engaging the electric coolant pump, and limiting operation of the automobile, when one of flow of coolant through the diverter valve is not verified and when the temperature of the coolant immediately downstream of the exhaust gas heat recovery unit is not approximately equal to the temperature of the coolant upstream of the radiator.

According to several aspects of the present disclosure, a cooling system for an automobile comprises a mechanical coolant pump and an electric coolant pump, a diverter valve, each of the mechanical coolant pump and the electric coolant pump feeding into the diverter valve, the diverter valve being switchable to allow flow from only one of the mechanical coolant pump and the electric coolant pump to pass therethrough and biased to allow flow from the electric coolant pump, a controller having a processor for executing control logic stored in a memory, the control logic including detecting when an engine of the automobile has been selectively started by an operator of the automobile, and a selectable valve adapted to block coolant flow through the engine, the control logic further including switching the selectable valve and blocking coolant flow through the engine and diverting coolant flow around the engine, dis-engaging the electric coolant pump, switching the diverter valve to allow flow from the mechanical coolant pump, and engaging the mechanical coolant pump, the control logic further including verifying operation of the mechanical coolant pump.

According to another aspect of the present disclosure, the cooling system for an automobile further includes a sensor adapted to identify the position of the diverter valve, the control logic further including verifying that the diverter valve is switched to allow flow from the mechanical coolant pump by receiving feedback from the sensor.

According to another aspect of the present disclosure, the cooling system for an automobile further includes a temperature sensor adapted to measure the temperature of the coolant that has been diverted around the engine immediately downstream of the diverter valve and a manifold temperature sensor adapted to measure the temperature of the coolant upstream of a radiator, the control logic further including verifying flow of coolant through the diverter valve by measuring the temperature of the coolant that has been diverted around the engine immediately downstream of the diverter valve, measuring the temperature of the coolant upstream of a radiator within the automobile, and comparing the temperature of the coolant that has been diverted around the engine immediately downstream of the diverter valve to the temperature of the coolant immediately upstream of the radiator.

According to another aspect of the present disclosure, the control logic of the controller further includes, dis-engaging the mechanical coolant pump, switching the diverter valve to allow flow from the electric coolant pump, and engaging the electric coolant pump, when flow of coolant through the diverter valve is verified and when the temperature of the coolant that has been diverted around the engine immediately downstream of the diverter valve is approximately equal to the temperature of the coolant immediately upstream of the radiator, dis-engaging the electric coolant pump, switching the diverter valve to allow flow from the mechanical coolant pump, and engaging the mechanical coolant pump, when coolant flow exceeding the capabilities of the electric cooling pump is required, and dis-engaging the mechanical coolant pump, switching the diverter valve to allow flow from the electric coolant pump, engaging the electric coolant pump, and limiting operation of the automobile, when one of flow of coolant through the diverter valve is not verified and when the temperature of the coolant that has been diverted around the engine immediately downstream of the diverter valve is not approximately equal to the temperature of the coolant upstream of the radiator.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
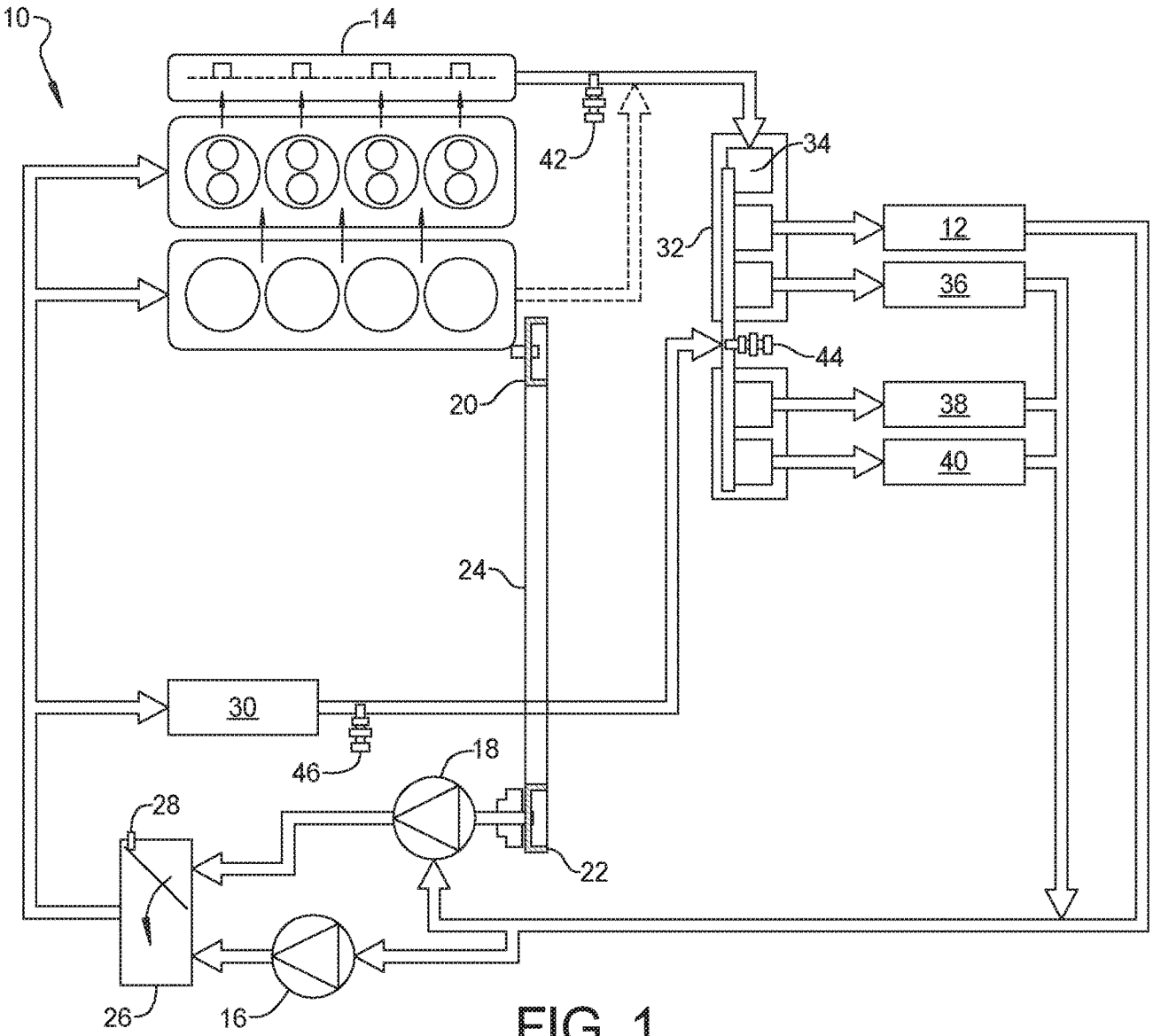
FIG. 1 is a schematic diagram of a cooling system according to an exemplary embodiment.

Referring to FIG. 1, a coolant system 10 in accordance with an exemplary embodiment of the present disclosure is shown. The coolant system 10 circulates coolant from a radiator 12 through an engine 14 of the automobile to control the temperature of the engine 14 during operation.

Either an electric coolant pump 16 or a mechanical coolant pump 18 is utilized to circulate coolant through the coolant system 10. The electric coolant pump 16 is powered by electricity from the electrical system of the automobile. The mechanical coolant pump 18 is powered by the engine 14. A pulley 20 is mounted onto a rotating shaft, such as the crank shaft, of the engine 14. The mechanical coolant pump 18 includes a pulley 22 and a belt or chain 24 extends around the pulleys 20, 22 so rotation of the engine is transferred to and powers the mechanical coolant pump 18.

Coolant from the radiator 12 is routed to both the mechanical coolant pump 18 and the electric coolant pump 16. Coolant is routed from both the mechanical coolant pump 18 and the electric coolant pump 16 to a diverter valve 26. The diverter valve 26 is switchable to allow flow from only one of the mechanical coolant pump 18 and the electric coolant pump 16 to pass through the diverter valve 26. A sensor 28 is mounted onto the diverter valve 26 to identify the position of the diverter valve 26 and send a signal to a controller within the automobile indicating a change in the position of the diverter valve 26 which indicates whether coolant is allowed to flow from the mechanical coolant pump 18 or the electric coolant pump 16.

After the diverter valve 26, the coolant path is split. A portion of the coolant flows to and through the engine 14 to provide cooling for the engine. A portion of the coolant flows through an exhaust gas heat recovery unit 30. Coolant leaves the engine 14 and the exhaust gas heat recovery unit 30 and flows into a manifold 32. The manifold 32 includes a selectable valve 34 that is adapted to block flow of coolant from the engine 14, thereby blocking the flow of coolant through the engine 14. Coolant flows from the manifold 32 to the radiator 12 and to other areas within the automobile such as the heater core 36, transmission oil heater 38, and engine oil heater 40.

Heat is transferred from the coolant within the radiator 12, the heater core 36, the transmission oil heater 38 and the engine oil heater 40. After the coolant is cooled, the coolant then returns to the mechanical coolant pump 18 and the electric coolant pump 16.

An engine temperature sensor 42 is positioned downstream of the engine 14 to measure the temperature of the coolant leaving the engine 14 and send that information to the controller within the automobile. A manifold temperature sensor 44 is positioned within the manifold 32 to measure the temperature of the coolant within the manifold 32 and send that information to the controller within the automobile. An exhaust gas temperature sensor 46 is positioned downstream of the exhaust gas heat recovery unit 30 to measure the temperature of the coolant leaving the exhaust gas heat recovery unit 30 and send that information to the controller.

Figure 2:
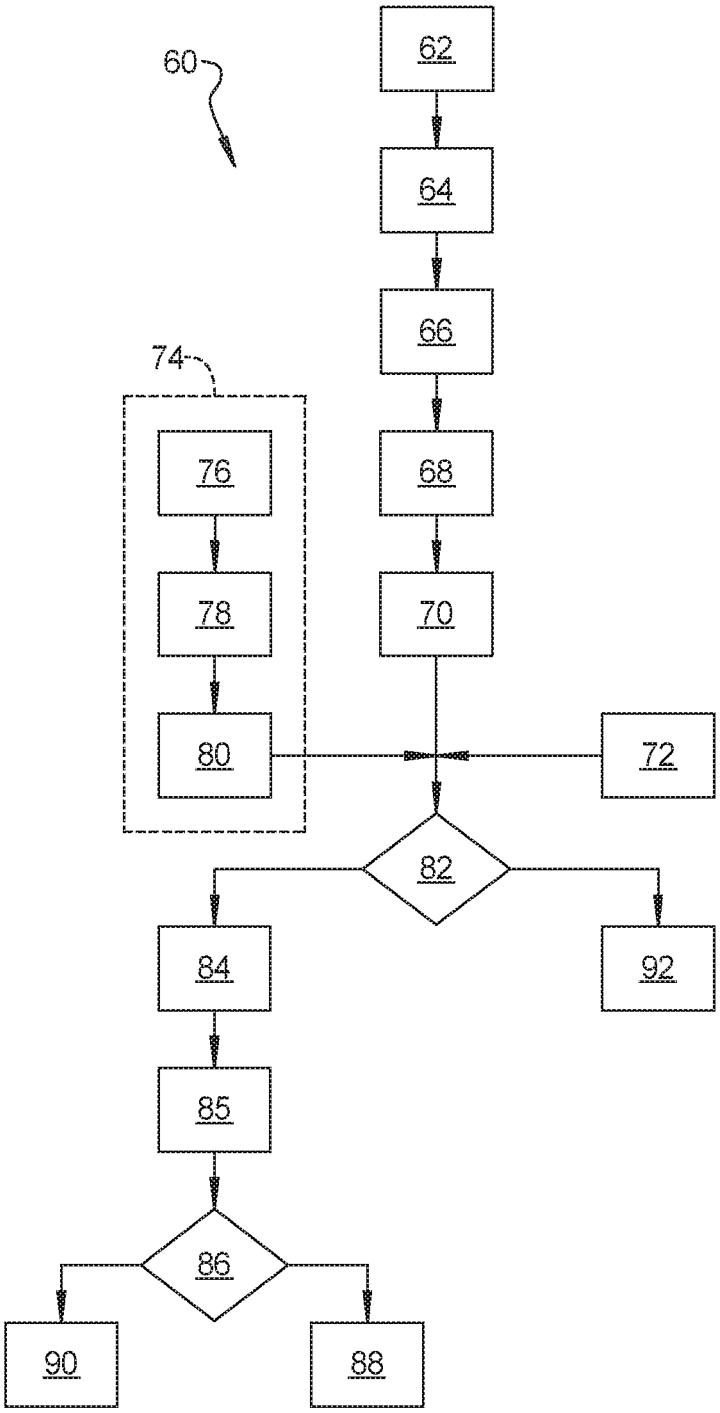
FIG. 2 is a schematic diagram of a method of operating a cooling system according to an exemplary embodiment.

Referring to FIG. 2, a method of diagnosing a mechanical coolant pump in an automobile equipped with cooling system having a mechanical coolant pump 18 and an electric coolant pump 16 that each feed into a diverter valve 26 adapted to allow flow from only one of the mechanical coolant pump 18 and the electric coolant pump 16 to pass therethrough is shown generally at 60.

Beginning at block 62, the method includes detecting when the engine 14 of the automobile has been selectively started by an operator. The method only looks for instances where the operator manually and selectively starts the automobile and ignores instances where the engine 14 of the automobile is started or re-started, such as in the case of a start/stop equipped automobile.

Moving to block 64, the method includes blocking coolant flow through the engine 14 and diverting coolant flow through the exhaust gas heat recovery unit 30 or in an alternate embodiment, through a parallel path around the engine that does not include an exhaust gas heat recovery unit 30. Coolant is blocked from flowing through the engine 14 by the selectable valve 34 that prevents coolant from flowing into the manifold 32 from the engine 14, thereby preventing coolant from flowing through the engine 14. Coolant is blocked from flowing through the engine 14 to allow the engine to warm up quickly. Higher fuel efficiency is achieved when the engine 14 is operating within normal temperature ranges. Once the engine 14 has warmed up to appropriate operating temperature, coolant flow will be allowed through the engine 14.

Moving to block 66, the method includes dis-engaging the electric coolant pump. Under normal operating conditions, the cooling system will operate with the electric coolant pump 16. The mechanical coolant pump 18 is only engaged when there is demand for increased coolant flow or when the mechanical coolant pump 18 is being evaluated or tested, such as by way of the present disclosure. Otherwise, the default operating condition will have the electric coolant pump 16 engaged.

Moving to block 68, once the electric coolant pump 16 is dis-engaged, the method includes switching the diverter valve 26 to allow flow from the mechanical coolant pump 18. Switching of the diverter valve can be actuated via pressure interactions on the face of the vale or via an actuator. After the electric coolant pump 16 is dis-engaged, and the diverter valve 26 is switched, moving to block 70, the mechanical coolant pump 18 is engaged.

If the mechanical coolant pump 18 is operating properly, the diverter valve 26 will be switched to allow flow from the mechanical coolant pump 18 and coolant pumped by the mechanical coolant pump 18 will flow through the diverter valve 26. Moving to block 72, the contact sensor 28 on the diverter valve 26 verifies that the diverter valve 26 is switched to allow flow from the mechanical coolant pump 18.

In an exemplary embodiment, the diverter valve 26 is biased to allow flow from the electric coolant pump 16 and switching the diverter valve 26 to allow flow from the mechanical coolant pump 18 prior to engaging the mechanical coolant pump 18 is accomplished by actuating a solenoid to overcome the bias within the diverter valve 26 to switch the diverter valve 26 to allow flow from the mechanical coolant pump 18.

In another exemplary embodiment, the contact sensor 28 is a magnetic contact sensor that magnetically engages the diverter valve 26 when the diverter valve 26 is biased to allow flow from the electric coolant pump 16. Feedback from the magnetic sensor confirms that the magnetic sensor is magnetically engaged with the diverter valve 26, and that the diverter valve 26 is switched to allow flow from the mechanical coolant pump 18.

In yet another exemplary embodiment, the diverter valve 26 is a rotary valve. The contact sensor 28 is a sensor adapted to identify the rotational position of the rotary valve to verify that the diverter valve 26 is switched to allow flow from the mechanical coolant pump 18.

Moving to block 74, the method includes verifying that coolant is flowing through the diverter valve 26. At block 76, the temperature of the coolant immediately downstream of the exhaust gas heat recovery unit 30 is measured by the exhaust gas heat recovery coolant temperature sensor 46. Alternatively, the temperature of the coolant that is diverted around the engine immediately downstream of the diverter valve 26 is measured.

Moving to block 78, the temperature of the coolant further downstream in a known location is measured by the manifold temperature sensor 44. By way of a non-limiting example, the location of the manifold temperature sensor 44 may be immediately upstream of the radiator 12. At block 80, the temperature of the coolant immediately downstream of the exhaust gas heat recovery unit 30, or alternatively, the temperature of the coolant that is diverted around the engine 14 immediately downstream of the diverter valve 26 is compared to the temperature of the coolant upstream of the radiator 12. If the temperature of the coolant immediately downstream of the exhaust gas heat recovery unit 30, or alternatively, the temperature of the coolant that is diverted around the engine 14 immediately downstream of the diverter valve 26 approximately matches the temperature of the coolant upstream of the radiator 12, then coolant must be flowing through the coolant system 10. There is likely to be some heat losses between the exhaust gas temperature sensor 46 and the manifold temperature sensor 44. The controller within the automobile will compare the temperatures. If the difference between the temperature of the coolant immediately downstream of the exhaust gas heat recovery unit 30 and the temperature of the coolant immediately upstream of the radiator 12 is within the margin of error contributed to these heat losses, then the temperature of the coolant immediately downstream of the exhaust gas heat recovery unit 30 and the temperature of the coolant upstream of the radiator 12 are considered approximately equal.

Moving to block 82, if the contact sensor 28 confirms that the diverter valve 26 is positioned to allow flow from the mechanical coolant pump 18, and if the comparison of temperatures between the exhaust gas temperature sensor 46 and the manifold temperature sensor 44 are approximately equal, then the controller determines that the mechanical coolant pump 18 is operating properly.

If the mechanical coolant pump 18 is operating properly, moving to block 84, the mechanical coolant pump 18 is dis-engaged, the diverter valve 26 is switched to allow flow from the electric coolant pump 16, and the electric coolant pump 16 is engaged. Moving to block 85, the temperature of the coolant is measured by the engine temperature sensor 42. Once the engine has reached a pre-determined operating temperature, coolant is allowed to flow through the engine 14.

The automobile cooling system 10 will operate this way, utilizing the electrical cooling pump 16 as long as operation of the automobile and coolant flow requirements are within the operating limits of the electric coolant pump 16.

Moving to block 86, if the controller determines that coolant flow requirements are within the operating limits of the electric coolant pump 16, then no action is taken, and the cooling system continues to operate utilizing only the electric coolant pump 16, as indicated at block 88.

If the controller determines that coolant flow requirements exceed the capabilities of the electric coolant pump 16, moving to block 90, the electric coolant pump 16 is dis-engaged, the diverter valve 26 is switched to allow flow from the mechanical coolant pump 18, and the mechanical coolant pump 18 is engaged. The cooling system 10 will continue to operate utilizing the mechanical cooling pump 18 for as long as elevated coolant flow is required.

Moving back to block 82, if either the contact sensor 28 fails to confirm that the diverter valve 26 is positioned to allow flow from the mechanical coolant pump 18, or if the comparison of temperatures between the exhaust gas heat recovery coolant temperature sensor 46 and the manifold temperature sensor 44 are not approximately equal, then the controller determines that the mechanical coolant pump 18 is not operating properly.

Moving to block 92, if the mechanical coolant pump 18 is not functioning properly, the mechanical coolant pump 18 is dis-engaged, the diverter valve 26 is switched to allow flow from the electric coolant pump 16, the electric coolant pump 16 is engaged, and operation of the automobile is limited to ensure that coolant flow requirements do not exceed the operational capabilities of the electric coolant pump 16. A signal will be sent to the operator of the automobile, and operation of the automobile will continue to be limited until the mechanical coolant pump 18 is repaired and proper operation can be confirmed.

The method of the present disclosure offers the advantage of regularly and automatically testing the mechanical coolant pump 18 to verify proper operation so the automobile can utilize the electric coolant pump 16 during normal operating conditions to maximize fuel economy while ensuring that the automobile is able to utilize the mechanical coolant pump 18 when elevated coolant flow is required. Further, the method of the present disclosure automatically limits the automobile if the mechanical coolant pump 18 is not functioning properly to prevent damage to the automobile due to operation outside the capabilities of the electric coolant pump 16.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A method of diagnosing a mechanical coolant pump in an automobile equipped with cooling system having a mechanical coolant pump and an electric coolant pump, the mechanical coolant pump and the electric coolant pump each feed into a diverter valve that allows flow from only one of the mechanical coolant pump and the electric coolant pump to pass therethrough, the method comprising:

using a controller having a processor for executing control Iodic stored in a memory and detecting when an engine of the automobile has been started;

dis-engaging the electric coolant pump;

switching the diverter valve to allow flow from the mechanical coolant pump;

engaging the mechanical coolant pump; and verifying the mechanical coolant pump is operating properly by:

verifying that the diverter valve is switched to allow flow from the mechanical coolant pump by receiving feedback from a sensor to identify the position of the diverter valve; and verifying flow of coolant through the diverter valve after the mechanical coolant pump has been engaged by:

measuring the temperature of the coolant that has been diverted around the engine immediately downstream of the diverter valve:

measuring the temperature of the coolant upstream of a radiator within the automobile; and comparing the temperature of the coolant that has been diverted around the engine immediately downstream of the diverter valve to the temperature of the coolant upstream of the radiator;

wherein the diverter valve is biased to allow flow from the electric coolant pump and switching the diverter valve to allow flow from the mechanical coolant pump prior to engaging the mechanical coolant pump includes actuating an actuator to overcome the bias within the diverter valve to switch the diverter valve to allow flow from the mechanical coolant pump, further wherein the sensor is a magnetic contact sensor that magnetically engages the diverter valve when the diverter valve is biased to allow flow from the electric coolant pump, further wherein receiving feedback from a contact sensor to identify the position of the diverter valve includes receiving feedback from the magnetic sensor identifying if the magnetic sensor is magnetically engaged with the diverter valve.

2. The method of claim 1, wherein detecting when an engine of the automobile has been started includes detecting when an engine of the automobile has been selectively started by an operator of the automobile and ignoring instances where the engine has been automatically started after a start/stop event.

3. The method of claim 1, wherein the switching valve is a rotary valve and verifying that the diverter valve is switched to allow flow from the mechanical coolant pump further includes receiving feedback from a sensor to identify the rotational position of the rotary valve.

4. The method of claim 1, further including blocking coolant flow through the engine with a selectable valve and diverting coolant flow around the engine prior to verifying flow of coolant through the diverter valve, and measuring the temperature of the engine and allowing coolant to flow through the engine after verifying flow of coolant through the diverter valve and after the engine has reached a predetermined operating temperature.

5. The method of claim 4, wherein blocking coolant flow through the engine and diverting coolant flow around the engine further includes diverting coolant flow around the engine through an exhaust gas heat recovery unit.

6. The method of claim 5, wherein verifying flow of coolant through the diverter valve further includes:

measuring the temperature of the coolant immediately downstream of the exhaust gas heat recovery unit;

measuring the temperature of the coolant upstream of a radiator within the automobile; and comparing the temperature of the coolant immediately downstream of the exhaust gas heat recovery unit to the temperature of the coolant upstream of the radiator.

7. The method of claim 6, further including:

dis-engaging the mechanical coolant pump, switching the diverter valve to allow flow from the electric coolant pump, and engaging the electric coolant pump, when flow of coolant through the diverter valve is verified and when the temperature of the coolant immediately downstream of the exhaust gas heat recovery unit is approximately equal to the temperature of the coolant immediately upstream of the radiator, and dis-engaging the electric coolant pump, switching the diverter valve to allow flow from the mechanical coolant pump, and engaging the mechanical coolant pump, when coolant flow exceeding the capabilities of the electrical cooling pump is required.

8. The method of claim 7, further including:

dis-engaging the mechanical coolant pump;

switching the diverter valve to allow flow from the electric coolant pump;

engaging the electric coolant pump; and limiting operation of the automobile, when one of flow of coolant through the diverter valve is not verified and when the temperature of the coolant immediately downstream of the exhaust gas heat recovery is not approximately equal to the temperature of the coolant upstream of the radiator.

9. The method of claim 1, further including:

dis-engaging the mechanical coolant pump, switching the diverter valve to allow flow from the electric coolant pump, and engaging the electric coolant pump, when flow of coolant through the diverter valve is verified and the temperature of the coolant that has been diverted around the engine immediately downstream of the diverter valve is approximately equal to the temperature of the coolant upstream of the radiator, and dis-engaging the electric coolant pump, switching the diverter valve to allow flow from the mechanical coolant pump, and engaging the mechanical coolant pump, when coolant flow exceeding the capabilities of the electrical cooling pump is required.

10. The method of claim 9, further including:

dis-engaging the mechanical coolant pump;

switching the diverter valve to allow flow from the electric coolant pump;

engaging the electric coolant pump; and limiting operation of the automobile, when one of flow of coolant through the diverter valve is not verified and when the temperature of the coolant that has been diverted around the engine immediately downstream of the diverter valve is not approximately equal to the temperature of the coolant upstream of the radiator.

11. A method of diagnosing a mechanical coolant pump in an automobile equipped with cooling system having a mechanical coolant pump and an electric coolant pump that each feed into a diverter valve adapted to allow flow from only one of the mechanical coolant pump and the electric coolant pump to pass therethrough and biased to allow flow from the electric coolant pump, comprising:

detecting when an engine of the automobile has been selectively started by an operator of the automobile;

blocking coolant flow through the engine and diverting coolant flow through an exhaust gas heat recovery unit;

dis-engaging the electric coolant pump;

actuating a solenoid to overcome the bias within the diverter valve and switching the diverter valve to allow flow from the mechanical coolant pump;

engaging the mechanical coolant pump;

verifying that the diverter valve is switched to allow flow from the mechanical coolant pump by receiving feedback from a contact sensor to identify the rotational position of the diverter valve;

verifying flow of coolant through the diverter valve by measuring the temperature of the coolant immediately downstream of the exhaust gas heat recovery unit, measuring the temperature of the coolant upstream of a radiator within the automobile, and comparing the temperature of the coolant immediately downstream of the exhaust gas heat recovery unit to the temperature of the coolant immediately upstream of the radiator;

dis-engaging the mechanical coolant pump, switching the diverter valve to allow flow from the electric coolant pump, and engaging the electric coolant pump, when flow of coolant through the diverter valve is verified and when the temperature of the coolant immediately downstream of the exhaust gas heat recovery unit is approximately equal to the temperature of the coolant immediately upstream of the radiator;

dis-engaging the electric coolant pump, switching the diverter valve to allow flow from the mechanical coolant pump, and engaging the mechanical coolant pump, when coolant flow exceeding the capabilities of the electric cooling pump is required; and dis-engaging the mechanical coolant pump, switching the diverter valve to allow flow from the electric coolant pump, engaging the electric coolant pump, and limiting operation of the automobile, when one of flow of coolant through the diverter valve is not verified and when the temperature of the coolant immediately downstream of the exhaust gas heat recovery unit is not approximately equal to the temperature of the coolant upstream of the radiator.

12. A cooling system for an automobile comprising:

a mechanical coolant pump and an electric coolant pump;

a diverter valve, each of the mechanical coolant pump and the electric coolant pump feeding into the diverter valve, the diverter valve being switchable to allow flow from only one of the mechanical coolant pump and the electric coolant pump to pass therethrough and biased to allow flow from the electric coolant pump;

a controller having a processor for executing control logic stored in a memory, the control logic including detecting when an engine of the automobile has been selectively started by an operator of the automobile;

a selectable valve adapted to block coolant flow through the engine, the control logic further including switching the selectable valve and blocking coolant flow through the engine and diverting coolant flow around the engine, dis-engaging the electric coolant pump, switching the diverter valve to allow flow from the mechanical coolant pump, and engaging the mechanical coolant pump;

a sensor adapted to identify the position of the diverter valve; and a temperature sensor adapted to measure the temperature of the coolant that has been diverted around the engine immediately downstream of the diverter valve and a manifold temperature sensor adapted to measure the temperature of the coolant upstream of a radiator;

the control logic further including verifying flow of coolant through the diverter valve by measuring the temperature of the coolant that has been diverted around the engine immediately downstream of the diverter valve, measuring the temperature of the coolant upstream of a radiator within the automobile, and comparing the temperature of the coolant that has been diverted around the engine immediately downstream of the diverter valve to the temperature of the coolant immediately upstream of the radiator, verifying operation of the mechanical coolant pump, and verifying that the diverter valve is switched to allow flow from the mechanical coolant pump by receiving feedback from the sensor.

13. The cooling system for an automobile according to claim 12, wherein the control logic of the controller further includes:

dis-engaging the mechanical coolant pump, switching the diverter valve to allow flow from the electric coolant pump, and engaging the electric coolant pump, when flow of coolant through the diverter valve is verified and when the temperature of the coolant that has been diverted around the engine immediately downstream of the diverter valve is approximately equal to the temperature of the coolant immediately upstream of the radiator;

dis-engaging the electric coolant pump, switching the diverter valve to allow flow from the mechanical coolant pump, and engaging the mechanical coolant pump, when coolant flow exceeding the capabilities of the electric cooling pump is required; and dis-engaging the mechanical coolant pump, switching the diverter valve to allow flow from the electric coolant pump, engaging the electric coolant pump, and limiting operation of the automobile, when one of flow of coolant through the diverter valve is not verified and when the temperature of the coolant that has been diverted around the engine immediately downstream of the diverter valve is not approximately equal to the temperature of the coolant upstream of the radiator.

* * * * *